US005611160A

United States Patent [19]

Topitzes

[11] Patent Number: 5,611,160

[45] Date of Patent: Mar. 18, 1997

[54] STACKABLE RIBBONS FOR IDENTIFICATION BADGES AND KIT THEREFOR

[76] Inventor: Nicholas J. Topitzes, 1750 Camelot Dr., Madison, Wis. 53705

[21] Appl. No.: 51,458

[22] Filed: Apr. 21, 1993

[51] Int. Cl.[6] ..... A44C 3/00

[52] U.S. Cl. ..... 40/1.6

[58] Field of Search ..... 40/594, 595, 611, 40/615, 605, 1.6, 1.5, 360, 630, 638, 299; 428/40, 913.3, 79; 283/100, 101, 904, 127

[56] References Cited

U.S. PATENT DOCUMENTS

| | | | |
|---|---|---|---|
| D. 164,312 | 8/1951 | Money | D11/97 X |
| D. 169,379 | 4/1953 | Manning | D11/97 X |
| 485,229 | 11/1892 | Reed | 40/617 |
| 4,447,481 | 5/1984 | Holmberg et al. | 428/40 |
| 4,586,975 | 5/1986 | Derby | 283/58 |
| 4,696,399 | 9/1987 | Windorski | 206/565 |

FOREIGN PATENT DOCUMENTS

| | | | |
|---|---|---|---|
| 2687493 | 8/1993 | France | 40/638 |
| 2618325 | 10/1977 | Germany | 40/605 |
| 423150 | 12/1993 | Germany | 40/638 |

OTHER PUBLICATIONS

Meeting Planners Supermarket & Computer Catalog, Catalog 4.0, published by Topitzes & Associates, Inc., published prior to 1993, advertisement on p. 21 for Badge Ribbons.

Heritage Products Catalog 1990–91, The Heritage Group, p. 8, Stock and Custom Satin Ribbons.

Crestline Co., Inc., Fall 1992 catalog, pp. 10,11, Custom Ribbons and Stock Ribbons.

Marco Co., 1992–1993 Catalog, pp. 4,5, Convention Ribbons.

*Primary Examiner*—Kenneth J. Dorner
*Assistant Examiner*—Cassandra Davis
*Attorney, Agent, or Firm*—Foley & Lardner

[57] ABSTRACT

A ribbon display badge unit includes a conventional plastic badge base such as a plastic pocket for name badges, with one or more stackable ribbons attached to the badge base. Each of the stackable ribbons is oriented horizontally with a word formed on the lower portion of the front face of each ribbon and an adhesive layer formed on the upper portion of the front face of each ribbon. A release sheet covering the adhesive is removed and a first ribbon is attached to the badge base by pressing the adhesive layer against the back surface of the badge base such that the badge base covers the upper portion of the ribbon but leaves the word on the lower portion of the ribbon exposed. A second ribbon may be mounted to the first ribbon by removing the release sheet from the adhesive and applying the adhesive of the second ribbon to the back face of the first ribbon such that the first ribbon covers the upper portion of the second ribbon but leaves the word on the second ribbon exposed. Additional ribbons may be attached in the same manner to form a string of ribbons, each of which may be of a different color and having a different word thereon to indicate the positions and titles of the individual wearing the badge.

5 Claims, 4 Drawing Sheets

STACKABLE RIBBONS FOR IDENTIFICATION BADGES AND KIT THEREFOR

FIELD OF THE INVENTION

This invention pertains generally to the field of name display badges worn by individuals for identification at meetings and conferences, and to the display of information in connection with such badges.

BACKGROUND OF THE INVENTION

Attendees at conferences and meetings typically are provided with display badges which are worn by the attendees to identify themselves and provide information concerning the attendees, such as the name of the attendee, company name, position with the company, location, and so forth. A very commonly used display badge is formed as a clear plastic pocket having a clasp by which the plastic pocket can be attached to clothing, with a card inserted into the plastic pocket bearing printing to identify the wearer.

At many conventions and meetings, it has become common practice to further identify particular participants in the meetings by attaching a ribbon with a title on it to the display badge. These ribbons are similar to award ribbons (e.g., a "blue ribbon", etc.), and are attached by an adhesive to hang from the badge. Examples of titles which have been used on these ribbons are "President", "Vice-President", "Board Member", "Press", "Officer", "Membership Committee", "Foundation", and so forth. Of course, many possible titles may be used, depending on the organization and the meeting. Some organizations have imprinted their logo on the ribbons, and others have custom designed ribbons which are specific to the organization.

Such display ribbons have generally had the type imprinted on the ribbon vertically, so that the word identifying the wearer is read from top to bottom. The ribbons are typically 1.5 inch to 2 inches across and about 6 inches long, with the printing extending vertically along the long dimension of the ribbon from top to bottom. If the individual wearing the badge has participated in several positions or has won several honors, he or she may have several ribbons of different colors hanging from his or her badge. Since different titles typically have different color ribbons, there is often a rainbow effect to the ribbons.

It has usually been a cumbersome job to attach the ribbons to the badges. The ribbons typically are attached by taping the top of the ribbon to the inside or backside of the badge. Cellophane tape (e.g., "Scotch"® tape) has often been used. More recently, double faced pressure sensitive adhesive tape has been used to attach the ribbons. Some manufacturers have attached a small strip of the double sided tape directly to the top of the ribbon. The tape is covered by a release sheet until the ribbon is to be used. To attach the ribbon to the badge, the release sheet is pulled off by the user and then the exposed pressure sensitive adhesive is pressed on to the back of the badge.

There are several problems with such prior ribbons. First, if there is only one ribbon, it appears like a long tail hanging from the badge. It is cumbersome and tends to wrinkle as it is worn. On the other hand, if several ribbons are being worn, such as three or more, it is difficult to attach them to the badge since the ribbons themselves are wider than the badge. Finally, the ribbons are difficult to read since the words on the ribbons are printed vertically, with the letters of the word one on top of the other, rather than horizontally as in normal printing.

SUMMARY OF THE INVENTION

In accordance with the present invention, a badge ribbon is provided which has its long dimension horizontally, with the printing pertaining to the individual wearer extending horizontally, which attaches by an adhesive strip on the front face of the upper half of the ribbon to either the back of the badge base or a higher ribbon. The ribbons are thus stackable so that ribbons providing different identifying words can be stacked one above the other under the badge base, with the words on each ribbon extending horizontally to be read in the normal manner for English language words, and typically with different words identifying different positions printed on ribbons of different colors. The stacked ribbons are thus easy to read, occupy significantly less space than prior ribbons which attach to a badge, provide a uniform and neat stack, and are easier to apply than has been the case with the typical prior ribbons.

In the application of the ribbon, a release sheet is peeled off by the user from a double sided adhesive tape which is attached to the front face of a ribbon, and the ribbon is attached to the back of the badge using the exposed adhesive tape. An additional ribbon is applied to the first ribbon by peeling off the release sheet from the adhesive tape on the front face of the second ribbon, and attaching the second ribbon to the back of the first ribbon using the adhesive tape. A third ribbon may be applied under the second ribbon in the same manner, and so forth for as many ribbons as desired.

The ribbons may be provided to a customer in a kit comprising a plurality of the stackable ribbons of the invention, each ribbon imprinted with a word or words which defines a particular title or honor, and with a variety of words provided in the kit. The stackable ribbons in the kit may be provided in a variety of colors, with each word on the ribbon associated with a specific color. Since the number of words which may be imprinted on the ribbons is much larger than the available colors, more than one word may be asssociated with a particular color, but preferably each particular word is associated only with one color.

Further objects, features and advantages of the invention will be apparent from the following detailed description when taken in conjunction with the accompanying drawings.

DETAILED DESCRIPTION OF THE INVENTION

Figure 1:
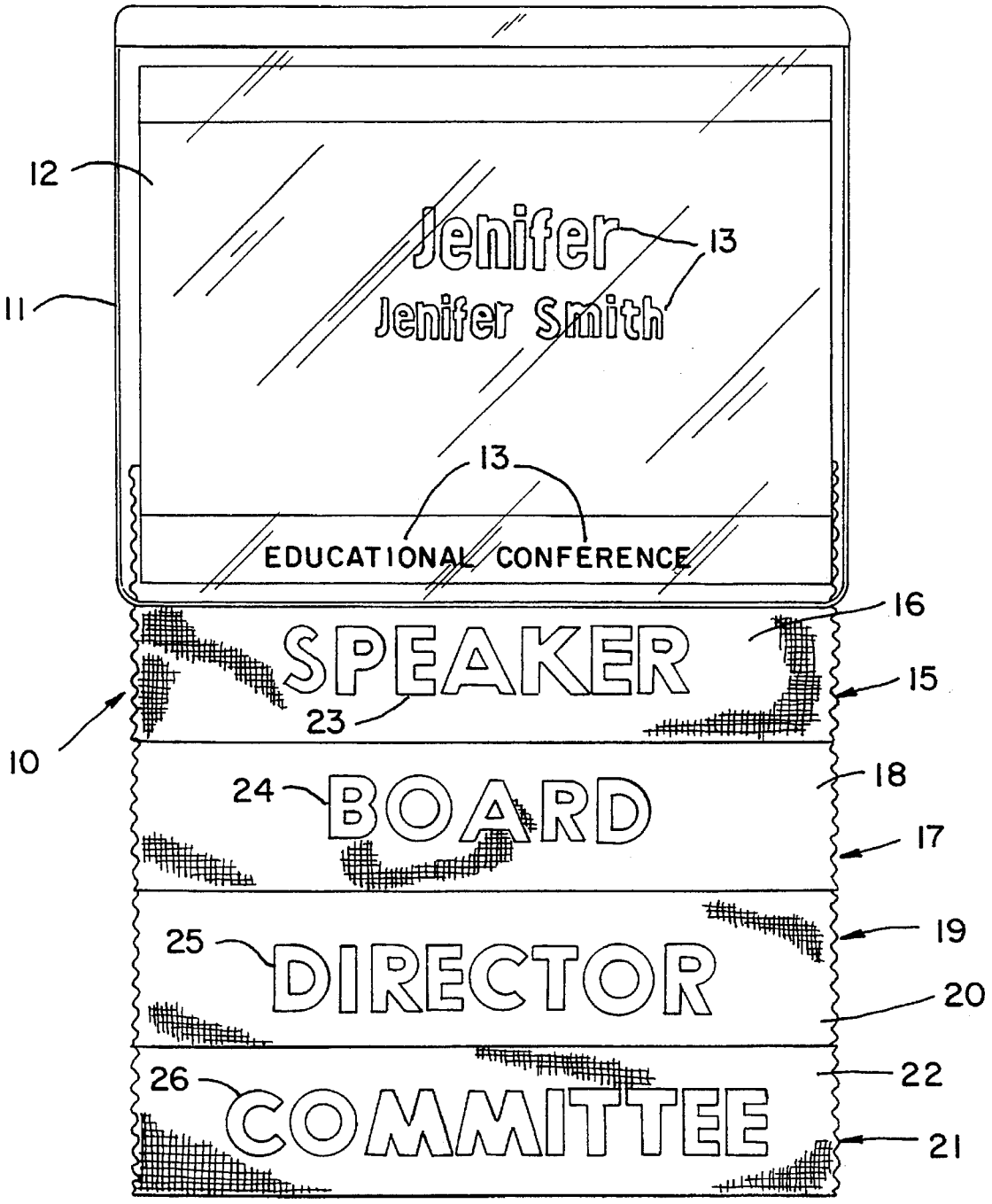
FIG. 1 is a plan view of an assembled ribbon display unit in accordance with the invention.

With reference to the drawings, a ribbon display badge unit in accordance with the invention is shown generally at 10 in FIG. 1. The assembled ribbon display badge unit 10 includes a base 11 such as a conventional badge pocket formed of a clear plastic, which has a card 12 inserted therein which bears printing 13 which identifies and provides other information concerning the wearer. As usual with English words and words of most European languages, the printing 13 is printed on the card 12 so as to be read horizontally from left to right. The ribbon display badge unit 10 also includes a stackable display ribbon 15 having a front face 16 which is attached to the back of the badge base 11 as described further below. The badge display unit 10 has ribbons in a stack, including a ribbon 17 with a front face 18, a ribbon 19 with a front face 20, and a ribbon 21 with a front face 22, each of the ribbons stacked in depending order. Letters defining words 23, 24, 25 and 26 are imprinted on the front faces of the ribbons 15, 17, 19 and 21, respectively. Each of the words 23–26 is printed on its respective ribbon so it extends horizontally and is read from left to right in the conventional English fashion. As shown in FIG. 1, the words 23–26 are aligned parallel to and are read in the same manner as the words 13 printed on the card 12. Thus, an observer can readily read all of the information on the badge unit since the words imprinted thereon are aligned in conventional English reading order with the words aligned one above the other.

The ribbons 15, 17, 19, and 21, as shown in FIG. 1 for purposes of illustration, each bear a different word which identifies a different position of the individual wearer. Preferably, each of the ribbons 15, 17, 19, and 21 is in a different color, e.g., the ribbon 15 may be red, the ribbon 17 white, the ribbon 19 green and the ribbon 21 blue (or other combinations of colors) so that the observer can readily distinguish the fact that the wearer has several different positions. It is also preferred that each word be associated with a specific color (i.e., the word 23, "Speaker", would preferably only appear on a red ribbon and not on a white or green ribbon), so that the various positions or functions of the speaker can be readily identified by an observer by association with the color.

Figure 2:
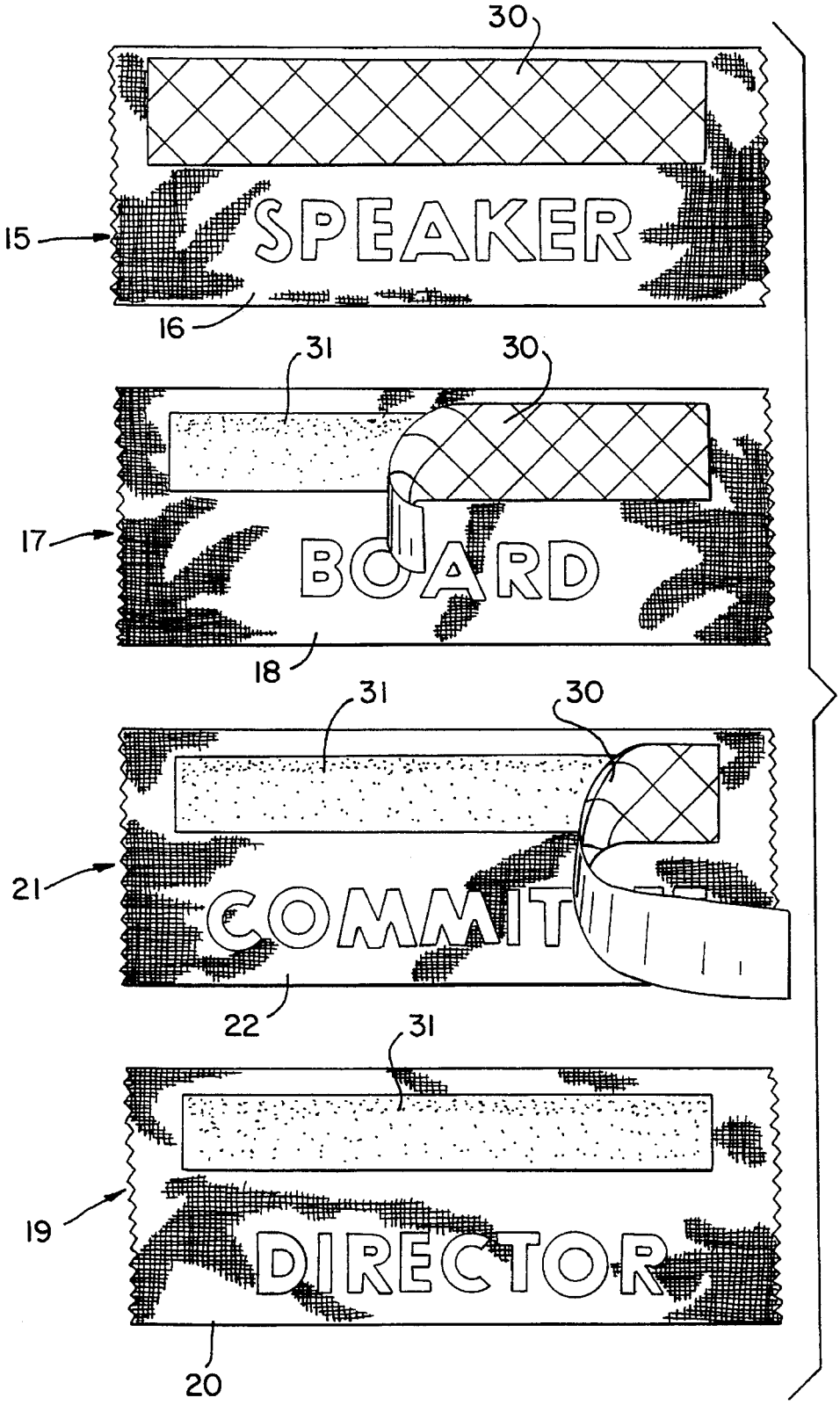
FIG. 2 is a plan view of a kit of stackable ribbon in accordance with the invention which illustrate the steps in the removal of the release sheet from an individual ribbon to expose the pressure sensitive adhesive thereunder.

FIG. 2 is an example of a kit of stackable ribbons which can be combined to provide the ribbon display badge unit 10 of FIG. 1. In the kit of FIG. 2, the four stackable ribbons 15, 17, 19 and 21 are shown, although it is understood that a kit of ribbons may comprise many ribbons, with many different words printed on them. For example, a kit may contain ribbons with many dozens of different words, with some words being repeated so that there are a plurality of ribbons bearing the same word, and with each word printed on a single color of ribbon. Because of the limited number of colors available, different words may be printed on the same color of ribbon, but preferably the same word is printed only on a ribbon of a single color. Generally, the kit will include ribbons of at least the colors red, green, blue, white, and yellow.

FIG. 2 also illustrates the manner in which the ribbons are prepared for attachment to the badge pocket. As shown in FIG. 2 with regard to the ribbon 15, a release sheet, typically having a shiny release surface on its inner surface, covers a tape 31 which has pressure sensitive adhesive on both sides and which is adhered to the front face 16 of the ribbon 15 and extends generally horizontally along the long dimension of the ribbon. The ribbon 17 is shown in FIG. 2 with the backing sheet 30 partially pulled off, the ribbon 21 is shown in FIG. 2 with the backing sheet 30 nearly completely pulled off, and the ribbon 19 is shown in FIG. 2 with the backing sheet completely removed to expose the pressure sensitive adhesive 31.

It is noted that all of the ribbons 15, 17, 19, and 21 have the letters defining the words extending horizontally along the long dimension of the ribbon in approximately the lower half of the front face of the ribbon, with the pressure sensitive adhesive strip 31 generally on the upper half of the front face. As illustrated in FIG. 2, each of the ribbons has its long dimension in the horizontal direction and its short dimension in the vertical direction. To fit typical speaker's badges, the long or horizontal dimension of the ribbon may be about 4 inches and the short or vertical dimension about 1 and ⅝ inches, although other dimensions may be used.

Figure 3:
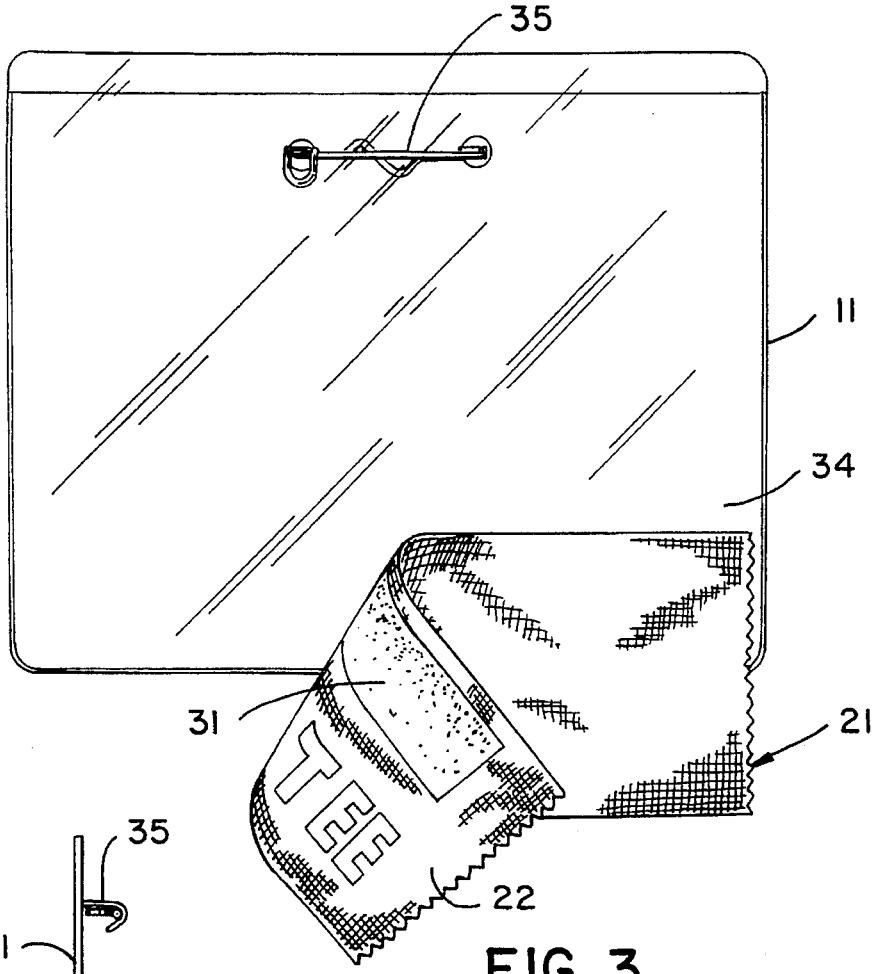
FIG. 3 is an illustrative view showing the application of a stackable ribbon by its adhesive tape to the back of a plastic badge pocket.

The attachment of a single ribbon, or the first ribbon, to the badge base pocket 11 is illustrated in FIG. 3. The ribbon 21 (as shown in FIG. 3 for exemplary purposes) is attached to the back face 34 of the plastic base 11. The pressure sensitive adhesive tape 31 is used to attach the ribbon 21 to the back face 34 so that the badge base 11 has its bottom edge covering about half of the ribbon 21. The badge base 11 includes a clasp such as a conventional pin clip 35 to attach the badge to the wearer's clothing, although a variety of other clasps are common (e.g., a spring loaded clasp) and may be used.

Figure 5:
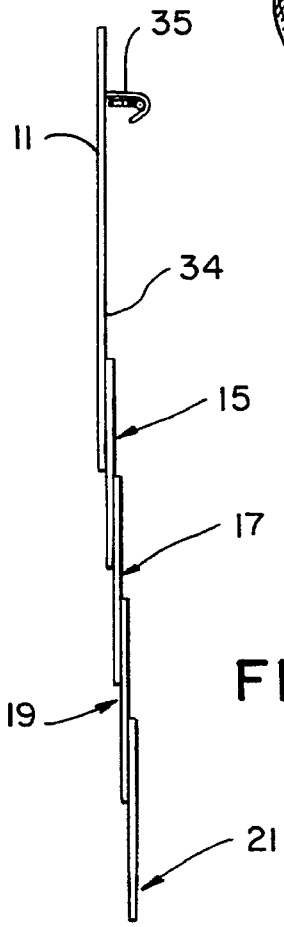
FIG. 5 is a side view of the ribbon display badge unit of FIG. 1.

A side view of the ribbon display badge unit is shown in FIG. 5 with the ribbons in the same order as in FIG. 1. As illustrated by FIG. 5, the additional ribbon 17, 19 and 21 can partially overlap the prior ribbons so that about the top half of the front face of each ribbon (the portion of the ribbon containing the pressure sensitive adhesive tape) is concealed by the bottom portion of the prior ribbon. As illustrated in FIG. 5, it is not necessary that each ribbon covers exactly one-half of the underlying ribbon.

Figure 4:
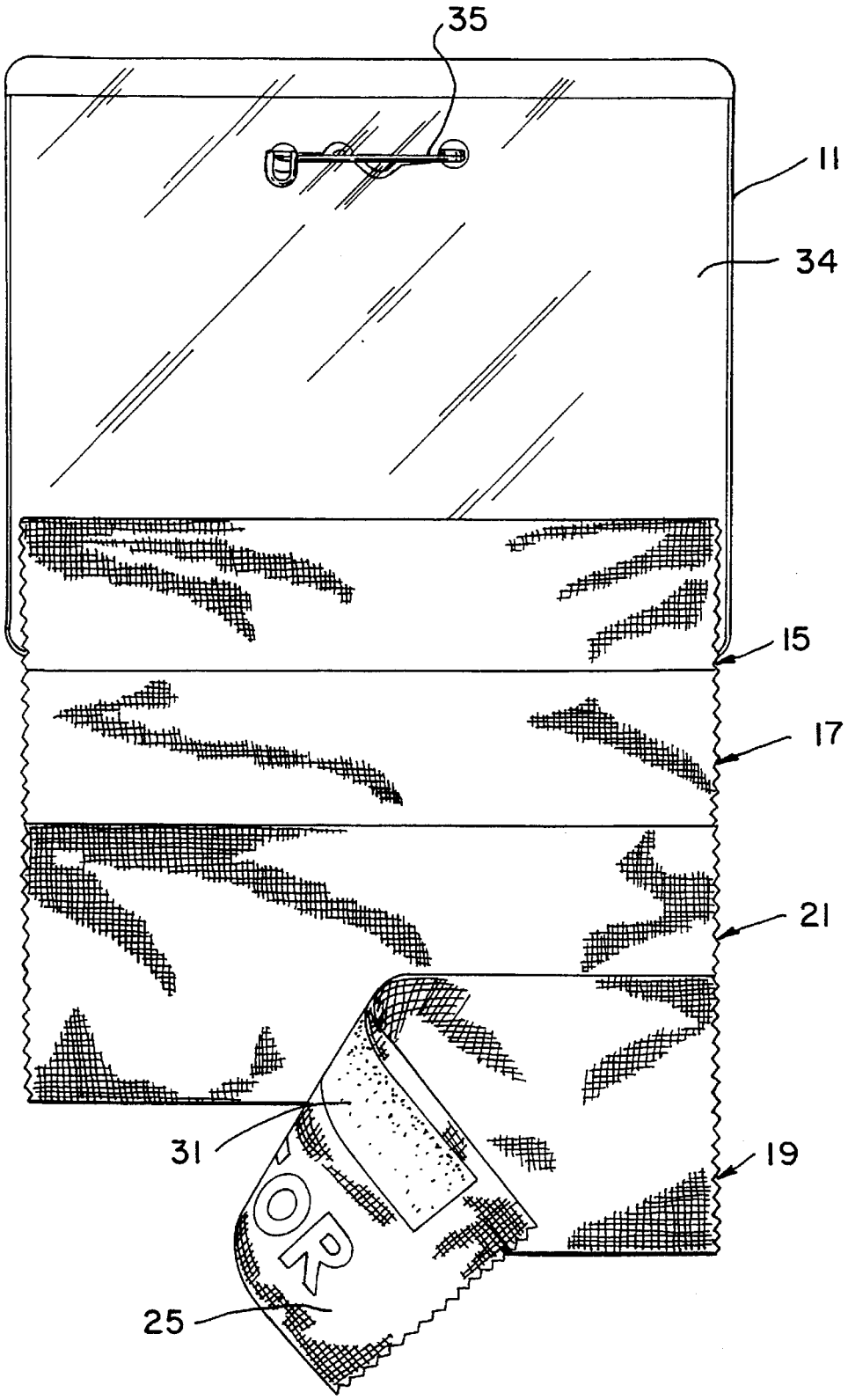
FIG. 4 is an illustrative view showing the application of an additional stackable ribbon to the back of a previously applied stackable ribbon.

FIG. 4 illustrate the attachment of a ribbon to the back of the underlying ribbon using the adhesive strip 31. This is accomplished by peeling off the release layer 30 and then applying the last ribbon so that the adhesive layer 31 engages the back surface of about the lower half of the underlying ribbon, and with the bottom edge of the underlying ribbon located such that the prior ribbon does not conceal the printing on the last attached ribbon.

The ribbons themselves may be formed of a variety of flexible materials, such as woven rayon, nylon, polyester, cotton, etc. Flexible plastic, paper, etc. may also be used for the ribbons if desired. The letters forming the words on the ribbons may be printed on them in various standard means, such as by screen printing.

It is thus seen that the stackable ribbon of the present invention may be readily combined into a ribbon display badge unit which provides significant additional information beyond that provided on the base badge, that such information is easy to read (since the words on all of the ribbons are aligned horizontally), and that the ribbons are conveniently and easily assembled to form a badge unit. The ribbons are available in a variety of colors and words which allow the customer to pick and choose the appropriate words that describe the functions or positions of the wearer, and the ribbons may provide color coding so that a color of ribbon corresponds to a particular word. The ribbons may be formed by conventional cutting operations from ribbon stock and be printed in a conventional, economical manner.

It is understood that the invention is not confined to a particular construction and arrangement of parts herein illustrated and described, but embraces such modified forms thereof as come within the scope of the following claims.

What is claimed is:

1. A ribbon display badge unit comprising:

(a) a display badge base having a front side and a back side and a clasp for attaching the badge base to an item of clothing of a wearer; and (b) a stackage ribbon attached to the back side of the base, the stackable ribbon comprising a ribbon of flexible material having a front face with an upper portion and a lower portion and a back face and having a long horizontal dimension and a vertical dimension which is shorter than the long horizontal dimension, at least one word formed on the lower portion of the front face and extending horizontally such that the word can be read when the long dimension of the stackable ribbon is oriented horizontally, a layer of pressure sensitive adhesive formed in a strip on the upper portion of the front face of the stackable ribbon, the stackable ribbon attached by the layer of adhesive to the back side of the base so that the base covers the upper portion of the front face of the stackable ribbon including the layer of adhesive but exposes the word formed on the stackable ribbon so that the word is oriented horizontally when the badge base is attached to an item of clothing of a wearer, wherein the stackable ribbon attached to the back side of the base is a first stackable ribbon having a first color, and a second stackable ribbon of a different color than the first color of the first stackable ribbon and comprising a ribbon of flexible material having a front face with an upper portion and a lower portion, a back face having an upper portion and a lower portion, a long horizontal dimension and a vertical dimension which is shorter than the long horizontal dimension, at least one word formed on the lower portion of the front face of the second stackable ribbon and extending horizontally such that the word on the second stackable ribbon can be read when the long dimension is oriented horizontally, and a layer of pressure sensitive adhesive formed in a strip on the upper portion of the front face of the second stackable ribbon, the second stackable ribbon attached to the lower portion of the back face of the first stackable ribbon by the adhesive layer on the front face of the second stackable ribbon.

2. The ribbon display badge unit of claim 1 wherein the stackable ribbon is about 4 inches long in the horizontal dimension and about 1⅝ inches long in the vertical dimension.

3. The ribbon display badge unit of claim 1 wherein the adhesive layer is formed of a double sided pressure sensitive adhesive tape.

4. A method of mounting stackable ribbons to a display badge base which can be worn on an item of clothing of a wearer, comprising the steps of:

(a) providing a plurality of stackable ribbons, each stackable ribbon comprising a ribbon of flexible material having a front face with an upper portion and a lower portion and a back face and having a long horizontal dimension and a vertical dimension which is shorter than the long horizontal dimension, at least one word formed on the lower portion of the front face of each stackable ribbon and extending horizontally such that the word can be read when the long dimension of the stackable ribbon is oriented horizontally, a layer of pressure sensitive adhesive formed on the upper portion of the front face of each ribbon, and a peelable release sheet covering the layer of pressure sensitive adhesive, wherein there are at least two stackable ribbons having different words formed thereon;

(b) peeling the release sheet off of a selected one of the stackable ribbons which contains a desired word to expose the pressure sensitive adhesive layer on the front face of the stackable ribbon;

(c) applying the upper portion of the stackable ribbon with the pressure sensitive adhesive layer thereon onto a lower portion of a back of the display badge base to attach the stackable ribbon thereto so that the display badge base covers the upper portion of the stackable ribbon but exposes the word formed on the stackable ribbon;

(d) including the further step of attaching at least one additional stackable ribbon selected from the plurality of stackable ribbons by peeling the release sheet from the pressure sensitive adhesive and applying the additional stackable ribbon to the stackable ribbon attached to the display badge base by pressing the pressure sensitive adhesive layer onto the back face of the stackable ribbon attached to the base such that the stackable ribbon attached to the base covers the upper portion of the additional stackable ribbon but exposes the word formed on the lower portion of the front face of the additional stackable ribbon.

5. The method of claim 4 wherein the plurality of ribbons are each of a different color and have a different word thereon.

* * * * *

UNITED STATES PATENT AND TRADEMARK OFFICE

CERTIFICATE OF CORRECTION

PATENT NO. : 5,611,160

DATED : March 18, 1997

INVENTOR(S) : Nicholas J. Topitzes

It is certified that error appears in the above-identified patent and that said Letters Patent is hereby corrected as shown below:

In column 5, line 1 of the patent, delete "stackage" and insert in its place --stackable--.

Signed and Sealed this

Twenty-sixth Day of May, 1998

*Attest:*

Bruce Lehman

BRUCE LEHMAN

*Attesting Officer*

*Commissioner of Patents and Trademarks*